US006536611B2

(12) United States Patent
Chen

(10) Patent No.: US 6,536,611 B2
(45) Date of Patent: Mar. 25, 2003

(54) WRENCH SUSPENSION RACK ASSEMBLY

(76) Inventor: Ander Chen, No. 392, Sec. 6, Chang Lu Rd., Fu Hsing Hsiang, Chang Hua Hsien (TW)

( * ) Notice: Subject to any disclaimer, the term of this patent is extended or adjusted under 35 U.S.C. 154(b) by 0 days.

(21) Appl. No.: 10/066,604

(22) Filed: Feb. 4, 2002

(65) Prior Publication Data

US 2002/0070185 A1 Jun. 13, 2002

Related U.S. Application Data

(63) Continuation-in-part of application No. 09/680,099, filed on Oct. 6, 2000, now abandoned.

(51) Int. Cl.[7] ..... A47F 7/00
(52) U.S. Cl. ..... 211/70.6
(58) Field of Search ..... 211/70.6; 206/372, 206/373, 376, 378

(56) References Cited

U.S. PATENT DOCUMENTS

| | | | | | |
|---|---|---|---|---|---|
| 5,036,975 | A | * | 8/1991 | Chow | 206/376 |
| 5,346,063 | A | | 9/1994 | Chow | 206/376 |
| 5,598,924 | A | | 2/1997 | McCann | 206/372 |
| 5,887,715 | A | | 3/1999 | Vasudera | 206/373 |
| 5,941,386 | A | | 8/1999 | Hu et al. | 206/376 |
| 5,967,340 | A | | 10/1999 | Kao | 211/70.6 |
| 5,975,297 | A | | 11/1999 | Kao | 206/378 |
| 5,996,817 | A | | 12/1999 | Kao | 211/70.6 |
| 6,039,188 | A | | 3/2000 | Lee | 206/758 |
| 6,044,985 | A | | 4/2000 | Kao | 211/70.6 |
| 6,092,656 | A | | 7/2000 | Ernst | 206/378 |
| 6,098,799 | A | | 8/2000 | Lee | 206/378 |
| 6,126,004 | A | | 10/2000 | Ling | 206/377 |
| D433,613 | S | | 11/2000 | Jialin | D8/71 |
| 6,202,864 | B1 | * | 3/2001 | Ernst et al. | 211/70.6 |
| 6,360,892 | B1 | * | 3/2002 | Chen | 206/376 |
| 6,401,923 | B1 | * | 6/2002 | Huang | 206/376 |

* cited by examiner

*Primary Examiner*—Robert W. Gibson, Jr.
(74) *Attorney, Agent, or Firm*—Alan D. Kamrath; Rider, Bennett, Egan & Arundel

(57) ABSTRACT

A wrench suspension rack assembly has a suspension base including two spaced protrusions on a side thereof and a wrench support rack for holding a plurality of tools. The wrench support rack includes a first side and a second side. Two spaced through-holes extend from the first side to the second side of the wrench support rack. The protrusions of the suspension base are respectively extended through the through-holes to thereby allow removable attachment of the wrench support rack to the suspension base.

20 Claims, 6 Drawing Sheets

3–3

WRENCH SUSPENSION RACK ASSEMBLY

CROSS REFERENCE TO RELATED APPLICATION

This is a continuation-in-part application of U.S. patent application Ser. No. 09/680,099 filed on Oct. 6, 2000, which is now abandoned.

BACKGROUND OF THE INVENTION

1. Field of the Invention

The present invention relates to a wrench suspension rack assembly.

2. Description of the Related Art

A conventional wrench suspension rack is used for hanging and retaining wrenches on the wall or on a display shelf so that the wrenches can be displayed in a supermarket, retail store or the like. However, the user has to cut or break the wrench suspension rack for removing and detaching the wrenches from the wrench suspension rack for use. The wrench suspension rack is thus broken and disposed accordingly. Namely, the wrench suspension rack is no longer usable for storing and supporting the wrenches. As a result, the user has to use an extra wrench holder for holding the wrenches. The cost for using the wrenches is thus increased.

FIG. 6 of the drawings illustrates a conventional wrench suspension rack 1 comprising a board 2 having two rows of holding members 3 on a side thereof. Aligned retaining holes 4 are defined in the vertically aligned holding members 3 for holding a wrench. Each retaining hale 4 is defined by two L-shaped resilient members (not labeled) having an opening 5 therebetween. However, the holding members 3 are integrally formed on the board 2 and thus could not be altered for holding wrenches of different sizes. Thus, different racks for wrenches of different size ranges and of different measurement systems (metric and inch) are required. The cost is thus high, and the use is limited.

SUMMARY OF THE INVENTION

A wrench suspension rack assembly in accordance with the present invention comprises a suspension base including two spaced protrusions on a side thereof and a wrench support rack for holding a plurality of tools. The wrench support rack includes a first side and a second side. Two spaced through-holes extend from the first side to the second side of the wrench support rack. The protrusions of the suspension base are respectively extended through the through-holes to thereby allow removable attachment of the wrench support rack to the suspension base.

The first side of the wrench support rack includes a plurality of grooves for removably retaining the tools in place. A wall defining each of the grooves includes at least one stop for retaining an associated one of the tools in place. A gate has a first end pivotally mounted to a side of the wrench support rack and a second end releasably engaged with another side of the wrench support rack. The gate closes the grooves for prohibiting removal of the tools from the grooves. The side of the suspension base includes indication marks provided thereon to indicate sizes of the tools retained in the grooves.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
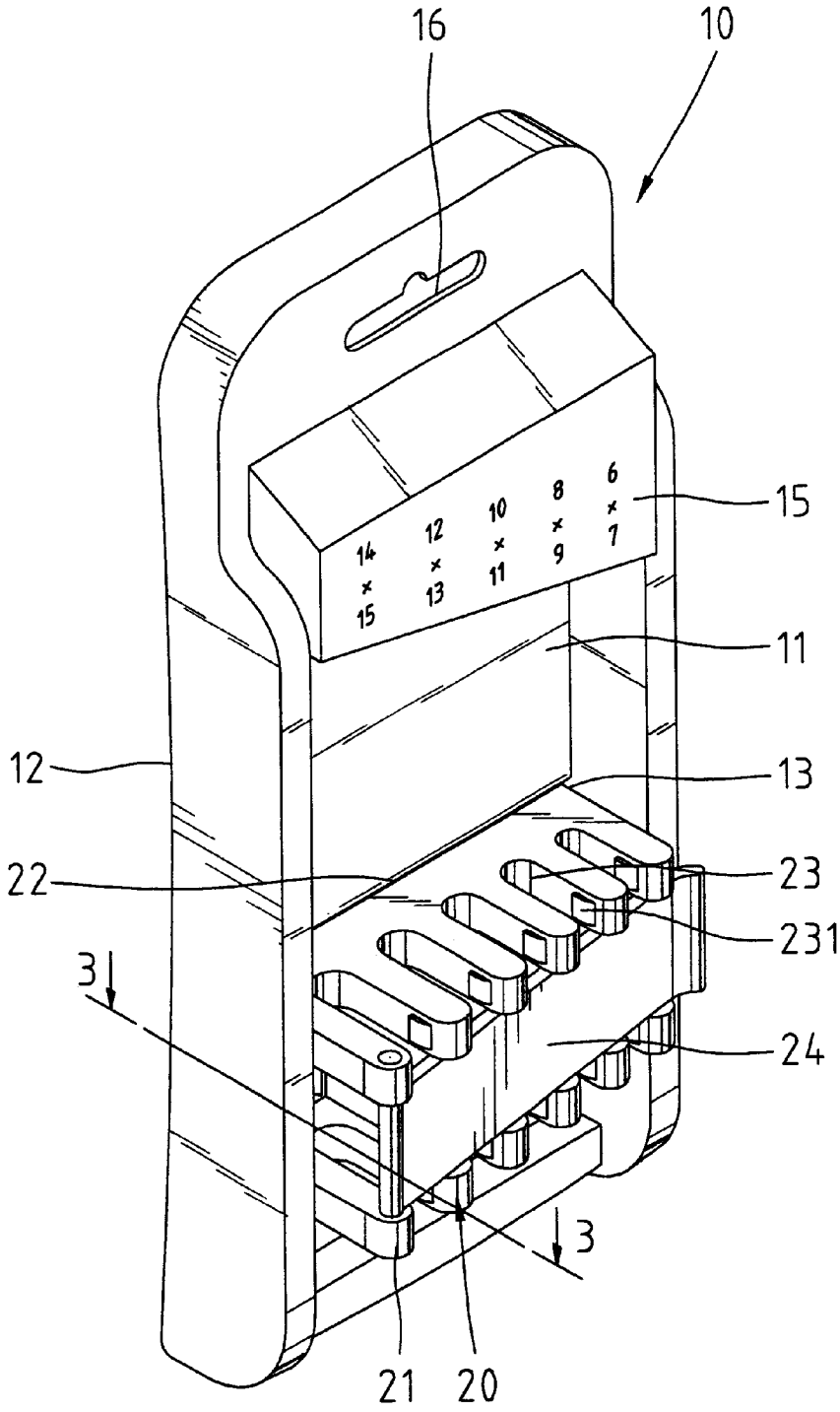
FIG. 1 is a perspective view of a wrench suspension rack assembly in accordance with the present invention.
Figure 2:
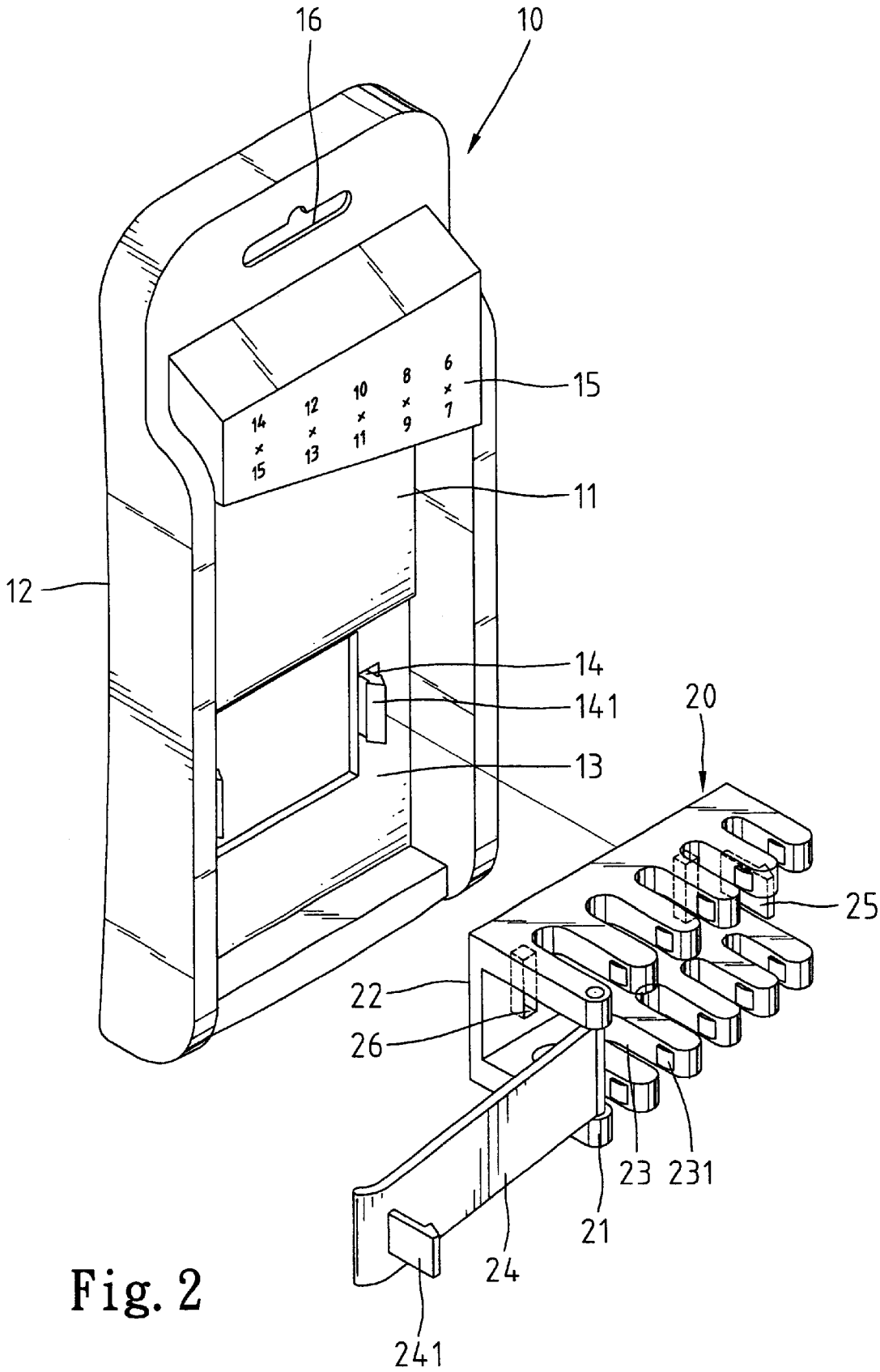
FIG. 2 is an exploded perspective view of the wrench suspension rack assembly in accordance with the present invention.

Referring to FIGS. 1 and 2, a wrench suspension rack assembly in accordance with the present invention generally comprises a suspension base 10 having a first side 11 and a second side 12 and a wrench support rack 20 removably attached to the suspension base 10. A recessed engaging portion 13 is defined in the first side 11 of the suspension base 10 and includes two spaced protrusions 14 each having a hook 141. Indication marks 15 for indicating sizes of the wrenches to be held in corresponding positions can be formed on the first side 11 of the suspension base 10. A suspension hole 16 is defined in the suspension base 10, allowing the suspension base 10 to be hung on a wall or the like.

The wrench support rack 20 includes a first side 21 and a second side 22. Two spaced through-holes 26 are defined in the wrench support rack 20 and extend from the first side 21 through the second side 22. Plural spaced grooves 23 of different sizes are defined in the first side 21 of the wrench support rack 20 for receiving wrenches of different sizes. Each of two sidewalls defining each groove 23 includes at least one stop 231 for retaining an associated wrench in place.

An engaging hook 25 is formed on a side of the wrench support rack 20. A gate 24 has a first end pivotally attached to the other side of the wrench support rack 20 and a second end having an engaging hook 241 for releasably engaging with the engaging hook 25. Thus, the gate 24 can be in a closed position shown in FIG. 4 for closing the grooves 23, thereby prohibiting removal of the wrenches 30 from the wrench support rack 20.

Figure 3:
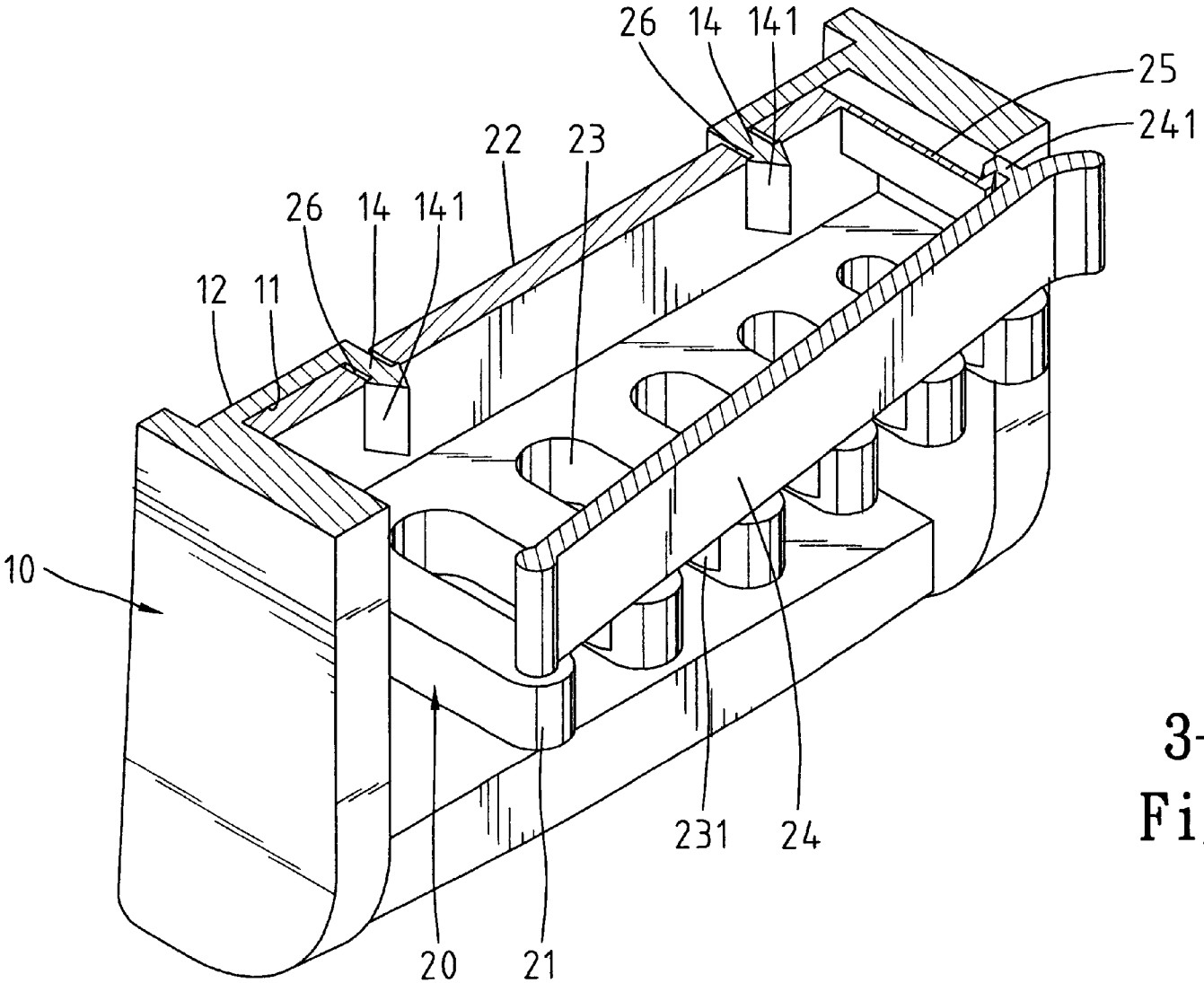
FIG. 3 is a perspective view, cut from plane 3—3 in FIG. 1, of the wrench suspension rack assembly in accordance with the present invention.

Referring to FIG. 3, when attaching the wrench support rack 20 to the suspension base 10, the hooks 141 of the protrusion 14 are respectively passed through the through-holes 26 of the wrench support rack 20 until the hooks 141 are engaged to the first side 21 of the wrench support rack 20.

The wrench support rack 20 can be removably attached to the suspension base 10. The shape, size, and color of the wrench support rack 20 can be designed according to the market's need, thereby meeting the requirement of the ever-changing market.

Figure 4:
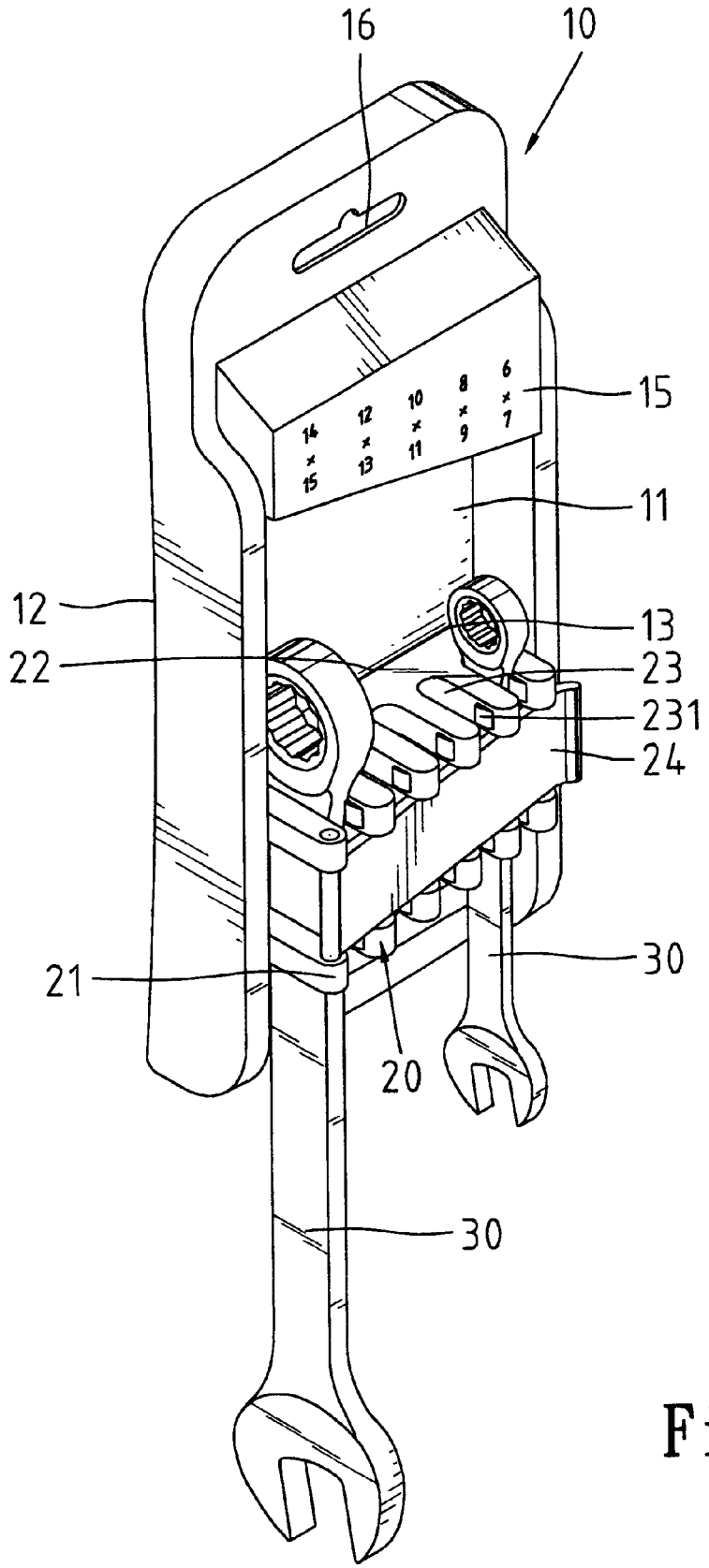
FIG. 4 is a perspective view illustrating use of the wrench suspension rack assembly in accordance with the present invention.

Referring to FIG. 4, wrenches 30 can be inserted into the grooves 23 according to their sizes and following the indication marks 15 on the first side of the suspension base 10. Rapid access of the wrenches 30 can be achieved. The wrenches 30 are reliably retained in place by the stops 231. Thus, falling or disengagement of the wrenches 30 from the grooves 23 is prevented even if the gate 24 is open.

Figure 5:
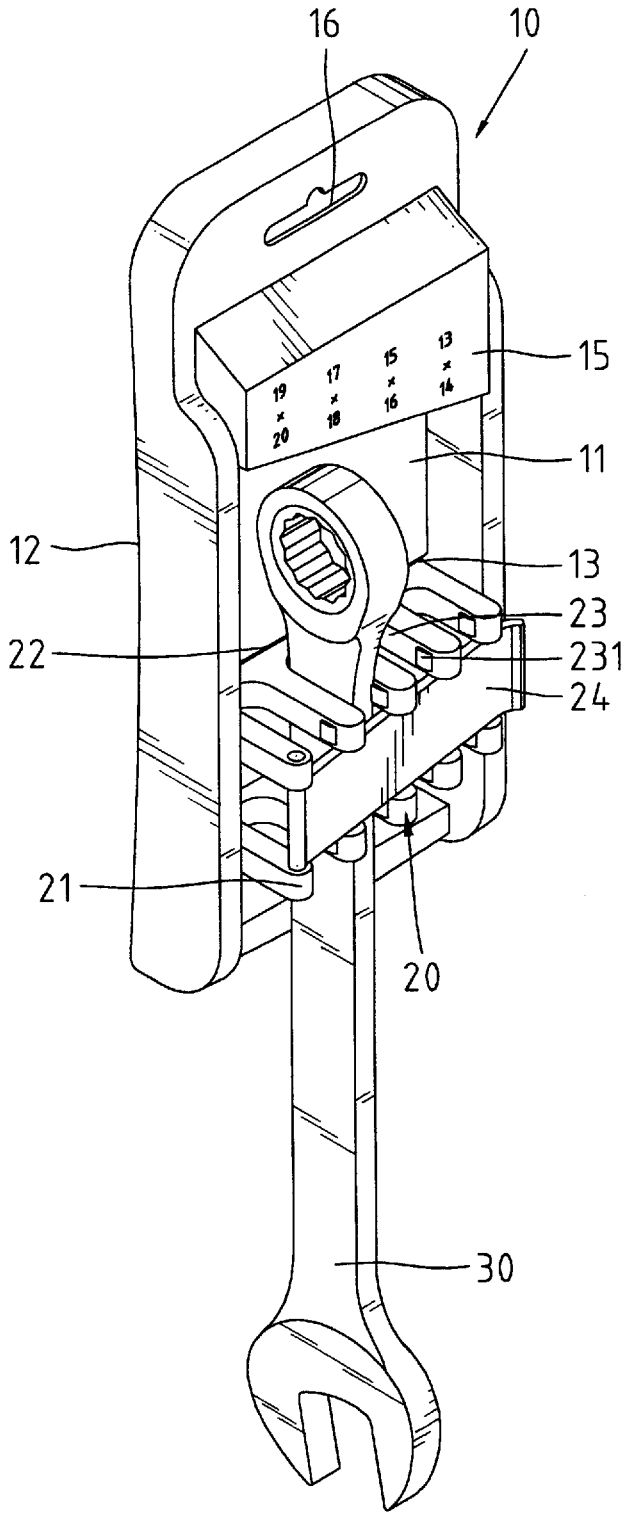
FIG. 5 is a perspective view illustrating a modified embodiment of the wrench suspension rack assembly in accordance with the present invention.
Figure 6:
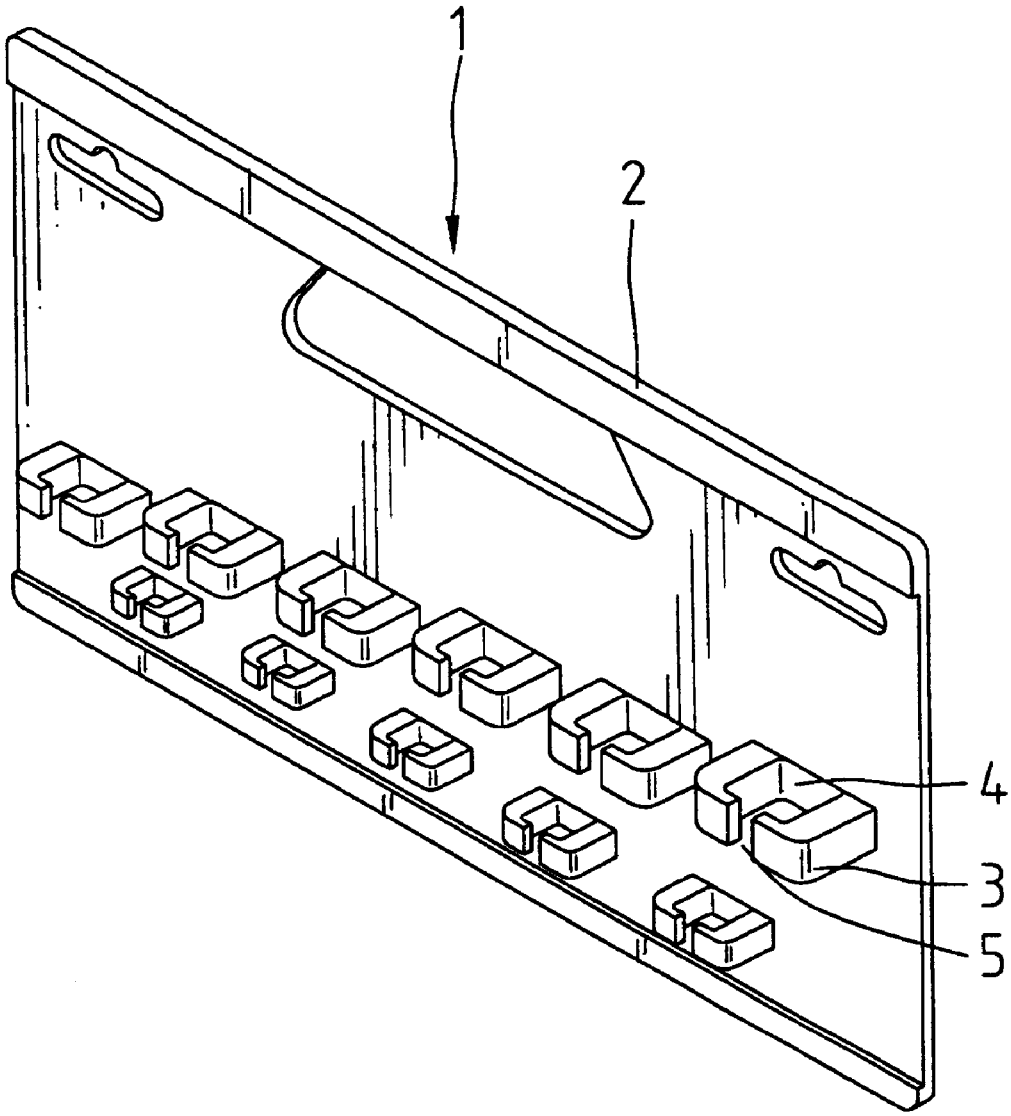
Fig. 6 PRIOR ART
FIG. 6 is a perspective view of a conventional wrench suspension rack.

FIG. 5 illustrates a modified embodiment, wherein like elements are designated by like numerals. In this embodiment, the number and the sizes of the grooves 23 in the first side 21 of the wrench support rack 20 are modified for receiving larger wrenches, and the corresponding indication marks 15 on the first side 11 of the suspension base 10 are changed.

According to the above description, it is appreciated that the wrench support rack 20 and the suspension base 10 may have numerous combinations in view of the possible change in the shape, size, and color of the wrench support rack 20. The gate 24 may prohibit removal of the wrenches 30 from the wrench support rack 20. The wrenches 30 are reliably retained in place by the stops 231 even if the gate 24 is open. The wrench support rack 20 can be used with tools other than the combination wrenches 30 shown in FIGS. 4 and 5, such as screwdrivers, spanners, adjustable wrenches, etc.

Although the invention has been explained in relation to its preferred embodiment, it is to be understood that many other possible modifications and variations can be made without departing from the scope of the invention as hereinafter claimed.

What is claimed is:

1. A wrench suspension rack assembly comprising:

a suspension base including two spaced protrusions on a side thereof; and a wrench support rack for holding a plurality of tools, the wrench support rack including a first side and a second side, two spaced through-holes extending on the first side to the second side of the wrench support rack, the protrusions of the suspension base being respectively extended through the through-holes to thereby allow removable attachment of the wrench support rack to the suspension base, wherein the first side of the wrench support rack includes a plurality of grooves for removably retaining the tools in place.

2. A wrench suspension rack-assembly comprising:

a suspension base; and a wrench support rack for holding a plurality of tools, the wrench support rack including a first side and a second side, with the wrench support rack removably attached to the suspension base with the second side of the wrench support rack engaged with the suspension base, wherein the first side of the wrench support rack includes a plurality of grooves for removably retaining the tools in place, wherein a wall defining each of the grooves includes at least one stop for retaining an associated one of the tools in place.

3. wrench suspension rack assembly comprising:

a suspension base;

a wrench support rack for holding a plurality of tools, the wrench support rack including a first side and a second side, with the wrench support rack removably attached to the suspension base, wherein the first side of the wrench support rack includes a plurality of grooves for removably retaining the tools in place; and a gate having a first end pivotally mounted to an edge of the wrench support rack and a second end releasably engaged with an opposite edge of the wrench support rack, the gate closing the grooves.

4. The wrench suspension rack assembly as claimed in claim 1, wherein the side of the suspension base includes indication marks provided thereon to indicate sizes of the tools retained in the grooves.

5. The wrench suspension rack assembly as claimed in claim 1, wherein the suspension base includes a suspension hole.

6. The wrench suspension rack assembly as claimed in claim 2, wherein the suspension base includes a recessed engaging portion for receiving at least a portion of the wrench support rack.

7. The wrench suspension rack assembly as claimed in claim 2, with the suspension base including two spaced protrusions on a side thereof, with the wrench support rack including two spaced through-holes extending from the first side to the second side of the wrench support rack, with the wrench support rack being removably attached to the suspension base by the protrusions of the suspension base being respectively extended through the through-holes.

8. The wrench suspension rack assembly as claimed in claim 7, wherein the side of the suspension base includes indication marks provided thereon to indicate sizes of the tools retained in the grooves.

9. The wrench suspension rack assembly as claimed in claim 8, wherein the suspension base includes a recessed engaging portion for receiving at least a portion of the wrench support rack.

10. The wrench suspension rack assembly as claimed in claim 8, wherein the suspension base includes a suspension hole.

11. The wrench suspension rack assembly as claimed in claim 7, wherein the suspension base includes a recessed engaging portion for receiving at least a portion of the wrench support rack.

12. The wrench suspension rack assembly as claimed in claim 7, a side of the suspension base engaging with the wrench support rack includes indication marks provided thereon to indicate sizes of the tools retained in the grooves.

13. The wrench suspension rack assembly as claimed in claim 7, wherein the suspension base includes a suspension hole.

14. The wrench suspension rack assembly as claimed in claim 7, wherein the suspension base includes a recessed engaging portion for receiving at least a portion of the wrench support rack.

15. The wrench suspension rack assembly as claimed in claim 7, further comprising a gate having a first end pivotally mounted to an edge of the wrench support rack and a second end releasably engaged an opposite edge of the wrench support rack, the gate closing the grooves.

16. The wrench suspension rack assembly as claimed in claim 3, with the suspension base including two spaced protrusions on a side thereof, with the wrench support rack including two spaced through-holes extending from the first side to the second side of the wrench support rack, with the wrench support rack being removably attached to the suspension base by the protrusions of the suspension base being respectively extended through the through-holes.

17. The wrench suspension rack assembly as claimed in claim 16, wherein the suspension base includes a recessed engaging portion for receiving at least a portion of the wrench support rack.

18. The wrench suspension rack assembly as claimed in claim 7, wherein a side of the suspension base engages with the second side of the wrench support rack and includes indication marks provided thereon to indicate sizes of the tools retained in the grooves.

19. The wrench suspension rack assembly as claimed in claim 3, wherein the suspension base includes a suspension hole.

20. The wrench suspension rack assembly as claimed in claim 3, wherein the suspension base includes a recessed engaging portion for receiving at least a portion of the wrench support rack.

* * * * *